US008711175B2

(12) United States Patent
Aarabi

(10) Patent No.: US 8,711,175 B2
(45) Date of Patent: Apr. 29, 2014

(54) METHOD AND SYSTEM FOR SIMULATING SUPERIMPOSITION OF A NON-LINEARLY STRETCHABLE OBJECT UPON A BASE OBJECT USING REPRESENTATIVE IMAGES

(75) Inventor: Parham Aarabi, Toronto (CA)

(73) Assignee: Modiface Inc., Toronto (CA)

( * ) Notice: Subject to any disclaimer, the term of this patent is extended or adjusted under 35 U.S.C. 154(b) by 120 days.

(21) Appl. No.: 13/208,900

(22) Filed: Aug. 12, 2011

(65) Prior Publication Data

US 2012/0127199 A1 May 24, 2012

Related U.S. Application Data

(60) Provisional application No. 61/458,408, filed on Nov. 24, 2010.

(51) Int. Cl.
*G09G 5/00* (2006.01)

(52) U.S. Cl.
USPC ..... 345/629; 345/419; 345/619; 345/632; 345/581; 345/582; 345/585; 382/321; 382/312; 382/111; 382/154; 358/471; 358/527; 358/518; 358/403; 358/501

(58) Field of Classification Search
CPC ..... G09G 5/14; G09G 2340/10; G09G 2340/125; G06T 11/60; G06T 15/503
USPC ..... 358/471, 527, 518, 403, 501; 382/321, 382/312, 111, 154; 345/419, 619, 629, 581, 345/582, 585, 632
See application file for complete search history.

(56) References Cited

U.S. PATENT DOCUMENTS

| | | | | |
|---|---|---|---|---|
| 4,949,286 | A * | 8/1990 | Ohba | 345/585 |
| 5,615,318 | A * | 3/1997 | Matsuura | 345/420 |
| 5,680,528 | A * | 10/1997 | Korszun | 345/630 |
| 5,724,522 | A * | 3/1998 | Kagami et al. | 705/26.44 |
| 5,850,222 | A * | 12/1998 | Cone | 345/418 |
| 5,982,926 | A * | 11/1999 | Kuo et al. | 382/167 |
| 6,282,329 | B1 * | 8/2001 | Ikeda | 382/309 |
| 6,307,568 | B1 * | 10/2001 | Rom | 345/629 |
| 6,404,426 | B1 * | 6/2002 | Weaver | 345/419 |
| 6,415,199 | B1 * | 7/2002 | Liebermann | 700/132 |
| 6,546,309 | B1 * | 4/2003 | Gazzuolo | 700/132 |
| 6,687,404 | B1 * | 2/2004 | Hull et al. | 382/226 |
| 6,901,379 | B1 | 5/2005 | Balter et al. | |
| 7,496,526 | B2 | 2/2009 | Razumov | |
| 7,548,794 | B2 | 6/2009 | Vandergriff et al. | |
| 7,826,997 | B2 * | 11/2010 | Wang | 702/127 |
| 8,026,917 | B1 * | 9/2011 | Rogers et al. | 345/473 |
| 8,165,711 | B2 * | 4/2012 | Brooking et al. | 700/132 |

(Continued)

*Primary Examiner* — Abderrahim Merouan
(74) *Attorney, Agent, or Firm* — Gowling Lafleur Henderson LLP

(57) ABSTRACT

A method and system for creating and using a virtual dressing room, by superimposing a non-linearly stretchable object image onto a base image in a display screen of a communication device, the images being planar. The method comprises scanning an encoded indicium associated with the object image, accessing and uploading a URL associated with the object image, the object image including a plurality of object image critical points, accessing the base image at the communication device, the base image including a plurality of base image critical points respectively corresponding to the object image critical points, re-mapping the object image via global transformation of coordinates associated with the object image critical points, such that the re-mapped object image critical points coincide with the respective base image critical points, and superimposing the re-mapped object image onto the base image for display at the display screen.

19 Claims, 5 Drawing Sheets

(56) References Cited

U.S. PATENT DOCUMENTS

| | | | | |
|---|---|---|---|---|
| 8,174,521 | B2 * | 5/2012 | Harvill et al. | 345/419 |
| 8,275,590 | B2 * | 9/2012 | Szymczyk et al. | 703/6 |
| 2002/0024517 | A1 * | 2/2002 | Yamaguchi et al. | 345/424 |
| 2002/0141626 | A1 * | 10/2002 | Caspi | 382/131 |
| 2004/0227752 | A1 * | 11/2004 | McCartha et al. | 345/419 |
| 2005/0083293 | A1 * | 4/2005 | Dixon | 345/102 |
| 2005/0131776 | A1 | 6/2005 | Perotti et al. | |
| 2005/0154487 | A1 * | 7/2005 | Wang | 700/132 |
| 2005/0234782 | A1 * | 10/2005 | Schackne et al. | 705/27 |
| 2005/0285876 | A1 * | 12/2005 | Balaga et al. | 345/629 |
| 2006/0171590 | A1 * | 8/2006 | Lu et al. | 382/190 |
| 2007/0173968 | A1 * | 7/2007 | Koichi | 700/141 |
| 2007/0239848 | A1 * | 10/2007 | Avery | 709/217 |
| 2009/0059175 | A1 * | 3/2009 | Le Quesne et al. | 353/28 |
| 2009/0109214 | A1 * | 4/2009 | Harvill et al. | 345/419 |
| 2009/0115916 | A1 * | 5/2009 | Kondo et al. | 348/745 |
| 2011/0148607 | A1 * | 6/2011 | Zeleny | 340/407.1 |
| 2012/0086783 | A1 * | 4/2012 | Sareen | 348/47 |
| 2012/0287122 | A1 * | 11/2012 | Nadar et al. | 345/419 |

* cited by examiner

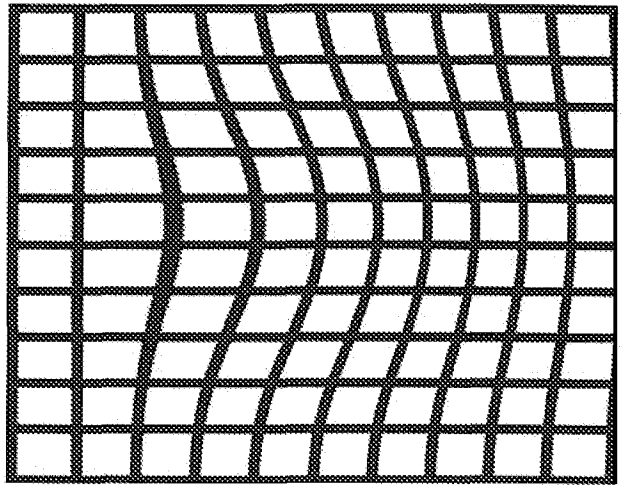
Figure 5b _After Stretching Step
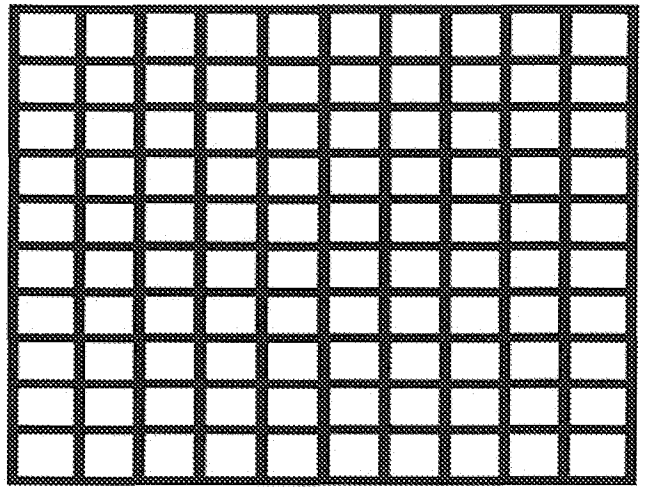
Figure 5a_ Before Stretching Step

METHOD AND SYSTEM FOR SIMULATING SUPERIMPOSITION OF A NON-LINEARLY STRETCHABLE OBJECT UPON A BASE OBJECT USING REPRESENTATIVE IMAGES

RELATED APPLICATION

This Application claims priority to U.S. Provisional Application No. 61/458,408 filed on Nov. 24, 2010. The disclosure of aforementioned U.S. Provisional Application No. 61/458,408 is hereby incorporated by reference in its entirety.

FIELD

The present disclosure relates generally to a system and method for simulating the superimposition of a non-linearly stretchable object upon a base object using representative planar images.

BACKGROUND

Trying on and buying clothing can be a significant chore. A potential shopper travels to a store, then typically will try on and fit several articles of clothing before finding the one piece of clothing that best meets their approval for being stylish, trendy and a good fit. Personally travelling to, and taking the time to try on clothes in the store can result in a significant inconvenience to many shoppers. This process may be simplified to allow shoppers/customers to save time, and as well allow retailers to capture sales that may otherwise remain unrealized due to potential shoppers' reticence in visiting a store, such as due to time and travel considerations.

A virtual dressing room system may advantageously provide time-saving benefits to the on-line internet shopper, enabling them to "try on", in a virtual context via simulation, any article of clothing based on their body profile as established using a personal digital photograph, prior to making a purchase.

SUMMARY

Provided is a method of superimposing an object image onto a base image in a display screen of a communication device, the images being planar. The method comprises scanning an encoded indicium associated with the object image; accessing and uploading a universal resource locator (URL) associated with the object image, the object image including a plurality of object image critical points; accessing the base image at the communication device, the base image including a plurality of base image critical points respectively corresponding to the object image critical points; re-mapping the object image via global transformation of coordinates associated with the object image critical points, such that the re-mapped object image critical points coincide with the respective base image critical points, and superimposing the re-mapped object image onto the base image for display at the display screen.

In an embodiment, the communication device comprises a mobile communication device.

In another embodiment, the communication device comprises an internet-enabled kiosk.

In yet another embodiment, the communication device comprises a computer coupled with a webcam.

In one embodiment, the encoded indicium comprises a quick response (QR) code.

In an alternate embodiment, the encoded indicium comprises a barcode.

The object image, in an embodiment directed to a virtual dressing room, comprises a digital image of an article of clothing.

In the virtual dressing room embodiment, the base image comprises a digital photograph image of at least a portion of a human body profile.

In the method provided, in one embodiment, superimposing the re-mapped object image onto the base image comprises assigning respective red-green-blue (RGB) values of the critical points of the object image to corresponding critical points of the body image.

Further to the method provided, re-mapping of the object image via global transformation of coordinates comprises re-arranging at least four key points of the object image to coincide with a respective at least four of key points of the object image, and stretching the object image in successive steps to align an additional set of object image key points to coincide with a respective additional set of base image key points.

Also provided is A computer system comprising a non-transitory computer readable memory, the memory having instructions stored thereon which when executed, cause the computer to implement the steps of the method.

Further provided is a communication device for creating and displaying an object image transformed and superimposed onto a base image in a display screen. The communication device comprises a code scanner module for scanning an encoded indicium associated with the object image; a base image database having the base image, the base image including a plurality of base image critical points; a coordinate transformation module for re-mapping the object image via global transformation of coordinates associated with a plurality of object image critical points, the object image critical points respectively corresponding to the base image critical points, such that the re-mapped object image critical points coincide with the respective base image critical points, the object image being accessed and uploaded via a universal resource locator (URL) associated therewith, and a superimposition module for superimposing the re-mapped object image onto the base image for display at the display screen.

In one embodiment, the communication device comprises a mobile communication device.

In yet another embodiment, the communication device comprises a communication network-accessible computer coupled with a webcam.

In a further embodiment, the encoded indicium comprises a quick response (QR) code.

In another embodiment, the encoded indicium comprises a barcode.

In a virtual dressing room embodiment, the object image comprises a digital image of an article of clothing.

Further to the virtual dressing room embodiment, the base image comprises a digital photograph image of at least a portion of a human body profile.

In an embodiment, the superimposition module superimposes the re-mapped object image onto the base image by assigning respective red-green-blue (RGB) values of the critical points of the object image to corresponding critical points of the body profile image.

BRIEF DESCRIPTION OF THE DRAWINGS

Embodiments will now be described by way of example only, with reference to the following drawings in which:

FIGS. 5*a* and 5*b* depict stretching the object image via global transformation of the object image coordinates, remapping its critical points to coincide with the corresponding base image critical points.

DETAILED DESCRIPTION

In the context of a virtual dressing room, a person's profile according to a digital photograph may represent a base image, while an article of clothing may be represented as a non-linearly stretchable object image. The act of a person trying on, or fitting on, the article of clothing or a garment in a virtual dressing room may be simulated by superimposing the object image upon the base image, once the non-linearly stretchable garment is transformed in shape and size to appropriately fit the person's profile as represented by digital photograph.

Figure 1:
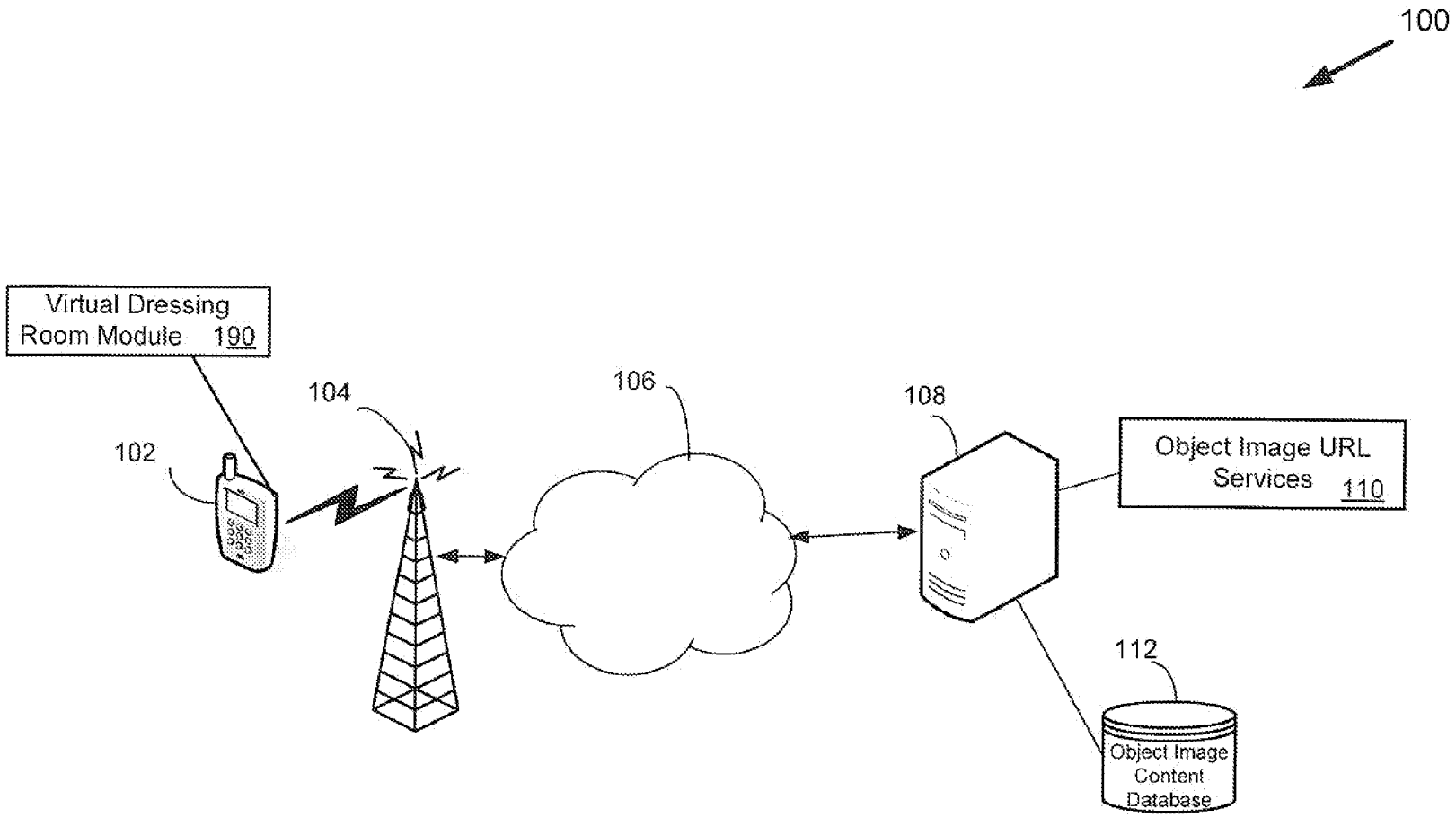
FIG. 1 shows one embodiment of a communication device and system for creating and displaying an object image superimposed onto a base image in a display screen.

FIG. 1 shows one embodiment of a communication system for creating and displaying an object image superimposed onto a base image in a display screen of a communication device. A communication system is illustrated generally by numeral 100. The communication system 100 comprises communication device 102, which may be a cell phone or a smartphone incorporating digital camera imaging functionality as well as barcode or Quick Response (QR) code scanning functionality, a base station or antenna 104, a communication network 106, and a Universal Resource Locator (URL) services server 190 accessibly coupled to object image content database 112. It will be understood by a person skilled in the art that the communication system 100 of FIG. 1 has been illustrated with a number of pertinent components for illustrative purposes only. Accordingly, a plurality of communication devices 102, base stations 104, communication networks 106, service servers 190 and databases 112 may be envisaged as needed.

Further, notwithstanding the FIG. 1 depiction of communication device 102 as a mobile communication device, it is contemplated that other types of communication devices, including both wired and wireless communication devices, may be employed. Communication device 102 includes virtual dressing room module 190 to implement processes for superimposing the object image onto the base image, for viewing in a display screen.

Figure 2:
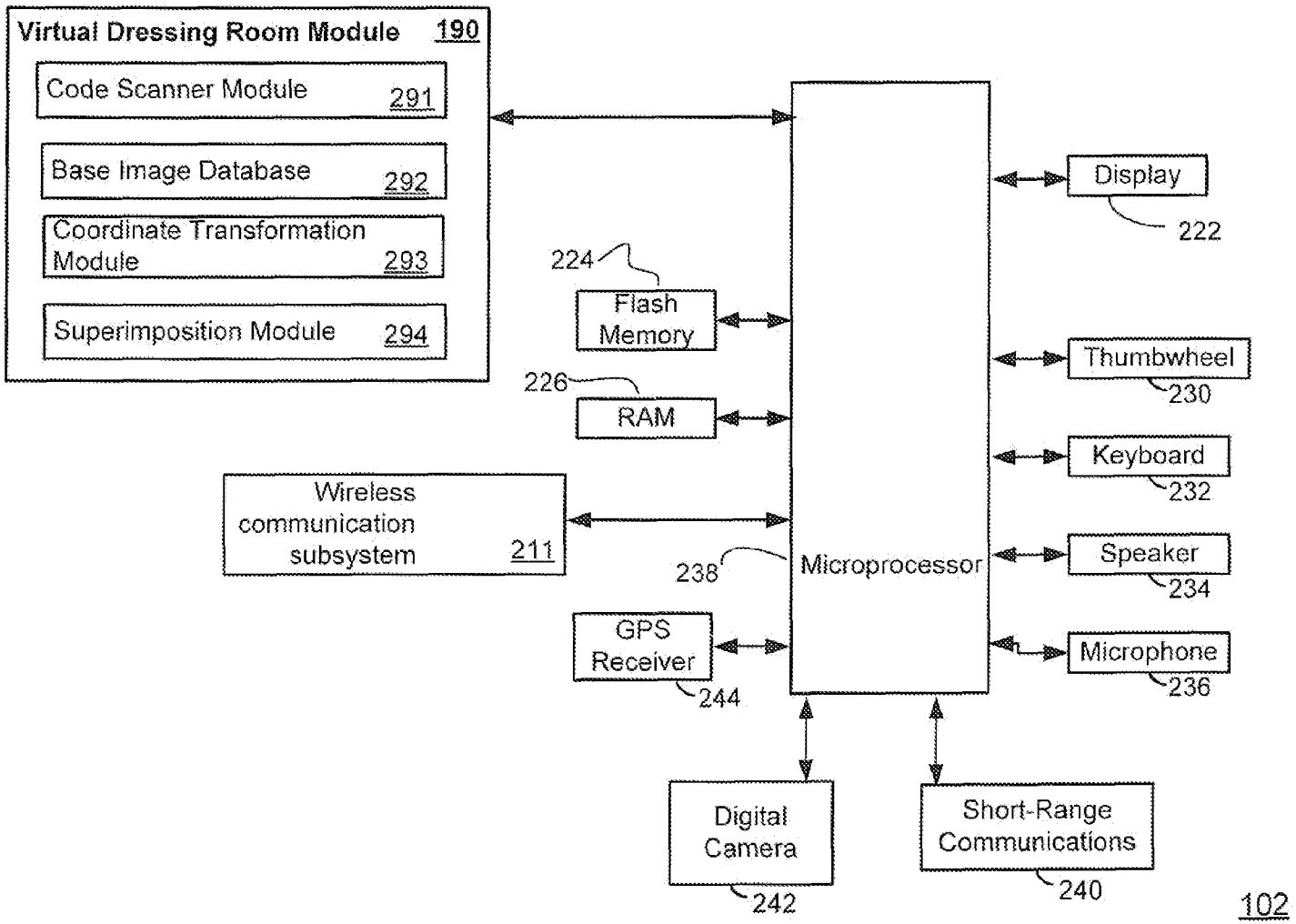
FIG. 2 shows, in an embodiment, architecture illustrative of the communication device.

Referring to FIG. 2, components of communication device 102 are illustrated in greater detail. Communication device 102 may be a two-way mobile communication device having both voice and data communication capabilities, including the capability to communicate with other computer systems. The functionality provided by communication device 102 may be provided variously by a camera cellphone, a cellphone with data communication capabilities, an internet-enabled web kiosk, a wireless internet appliance, or a data communication device such as a computer with a webcam.

Communication device 102 may include wireless communication subsystem 211, which includes a receiver, a transmitter, and associated components, such as one or more embedded or internal antenna elements and a processing module such as a digital signal processor (DSP). As will be apparent to those skilled in field of communications, the particular design of the communication subsystem 211 depends on the communication network in which communication device 102 is intended to operate.

Communication device 102 further includes microprocessor 238 which controls general operation of communication device 102. Microprocessor 238 may interact with additional device subsystems such as a display screen 222, a flash memory 224, a random access memory (RAM) 226, auxiliary input/output (I/O) subsystems 228, a keyboard 232, a speaker 234, a microphone 236, a short-range communications subsystem 240 such as Bluetooth™ for example, and any other device subsystems or peripheral devices generally designated at 242. Communication device 102 may also include a positioning device 244, such as a GPS receiver for receiving positioning information, and also a digital camera 242 to acquire and store digital images.

Operating system software used by the microprocessor 238 may be stored in a persistent store of memory such as the flash memory 224, which may alternatively be a read-only memory (ROM) or similar storage element (not shown). Those skilled in the art will appreciate that the operating system, specific device applications, or parts thereof, may be temporarily loaded into a volatile store of memory such as RAM 226.

The microprocessor 238, in addition to its operating system functions, typically enables execution of software applications on communication device 102. These basic operations typically include data and voice communication applications, for example. Additionally, applications may also be loaded onto the communication device 102 via communication network 106, short-range communications subsystem 240, or any other suitable subsystem 242, and installed by a user in RAM 226, or the flash memory persistent (non-transitory) store 224, for execution by the microprocessor 238. Such flexibility in application installation increases the functionality of the communication device 102 and may provide enhanced on-device features, communication-related features, or both.

The display screen 222 is used to visually present an application's graphical user interface (GUI) to the user. The user can manipulate application data by modifying information on the GUI using an input device such as the keyboard 232 or the thumbwheel 230, for example. Depending on the type of communication device 102, the user may be provided with other types of input devices, such as, for example, a scroll wheel, trackball, light pen, or a touch sensitive display screen incorporated into display screen 222.

Virtual dressing room module 190 of communication device 102 includes code scanner module 291, base image database 292, coordinate transformation module 293 and image superimposition module 294.

Code scanner module 291 may comprise any combination of software, firmware and hardware to scan encoded indicium such as barcodes or Quick Response (QR) codes typically associated with, or co-located with, object images. The object image may be a planar representation of a dress or other garment, for instance, such as depicted in an advertisement for the dress. Details of the object image may be accessed remotely from communication device 102 from URL services server 108 or object image content database 112 over communication network 106. Details of the object image, in the embodiment of a dress garment, may include coordinate data, dimensional data and Red-Green-Blue (RGB) data for certain critical points delineated on the object image, as will be discussed below with reference to FIG. 3*b*.

Base image database 292 comprises a repository of digital images of personal or user body profiles, or partial body profiles, for use as a base image in the virtual dressing room. Details of the base image, in the embodiment of a body profile or partial body profile, may include coordinate data, dimensional data and Red-Green-Blue (RGB) data for corresponding critical points delineated on the base image, again as will be discussed below with reference to FIG. 3*a*.

Coordinate transformation module 293 may comprise any combination of software, firmware and hardware to generate global coordinate transformations in simulating stretching of non-linearly stretchable object images, for re-mapping onto corresponding delineated points on the base image. It is contemplated that coordinate transformation module 293, or its comparable functionality, may be implemented and located alternatively on URL services server 108, which is communicatively coupled to with communication device 102 via communication network 106.

Image superimposition module 294 may comprise any combination of software, firmware and hardware to superimpose, or blend, the re-mapped object image onto the base image for display at a display screen, for example, at display screen 222 of communication device 102.

Figure 3A:
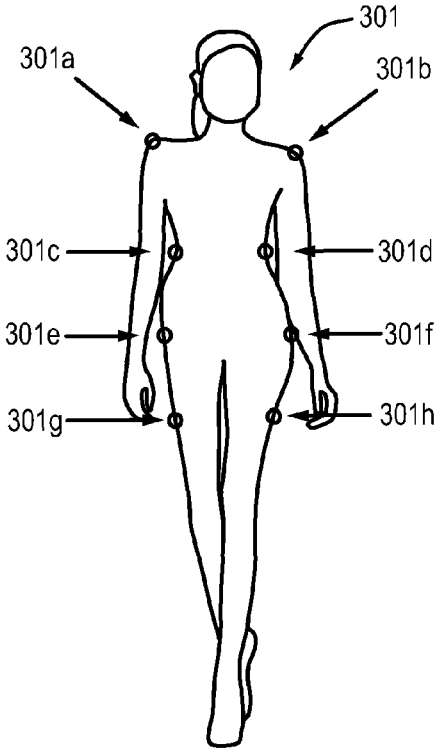
FIG. 3*a* illustrates an embodiment of a base image, a digital image of a person's profile, such as from a digital photograph, having specifically delineated critical points of the base image.

With reference now to FIG. 3*a*, illustrated is an embodiment of base image 301 is a digital image of a person's body profile, such as from a digital photograph of the person's body, or partial body profile, having specifically delineated critical points on the base image. The delineated critical points include dimensional, coordinate, and RGB data for shoulder points 301*a* and 301*b*, waist points 301*c* and 301*d*, hip points 301*e* and 301*f*, and thigh points 301*g* and 301*h*. Data for all points comprising base image 301 may similarly be available and accessible at base image database 292 of communication device 102.

It is contemplated that base image database 392 would be created by a user of the system, by uploading their photograph which includes a profile of their body, or at least a part of their body, then adjusting or entering, as appropriate, the critical points as depicted in FIG. 3*a*.

Figure 3B:
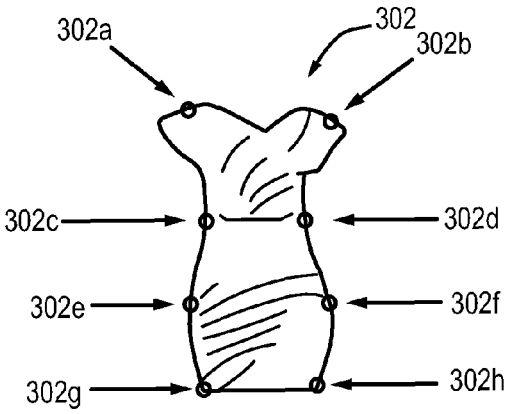
FIG. 3*b* illustrates an embodiment of an object image, a planar representation of a dress garment, for example, the dress garment having critical points on the object image correspondingly delineated as for the base image.

FIG. 3*b* illustrates an embodiment of object image 302, in this embodiment being a planar representation of a dress garment. The dress garment may be provided, for example, at a published advertisement having a depiction of the dress garment, with coordinate, dimensional and RGB data being accessible from URL services server 108.

It is contemplated that communication device 102 may include a search option to search a dress gallery or bridal registry, hosted at URL services server 108 or object image content database 112, for example, using keywords to show the dresses or garments that can be fitted or tried on.

The object image data for the dress garment is created to similarly include data for the critical points delineated thereon corresponding to respective critical points as delineated for the base image 301. In the embodiment depicted, the object image critical points comprise shoulder points 302*a* and 302*b*, waist points 302*c* and 302*d*, hip points 302*e* and 302*f*, and thigh points 302*g* and 302*h*, correlated to correspondingly delineated critical points of base image 301.

Figure 3C:
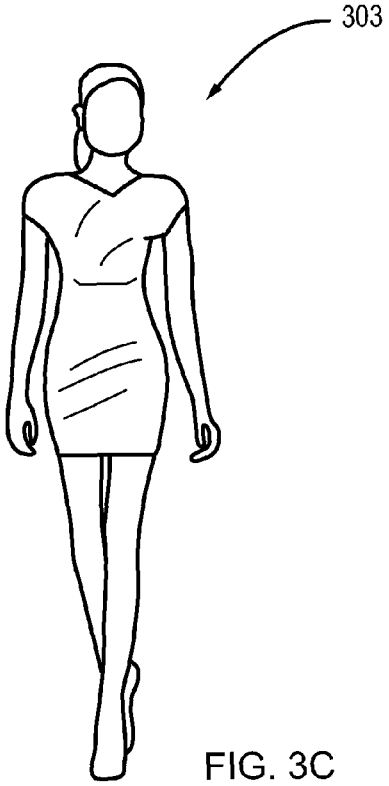
FIG. 3*c* illustrates, for the embodiment used, the superimposing of the re-mapped object image onto the base image for display at the display screen of the communication device.

FIG. 3*c* illustrates, for the image embodiments depicted in FIGS. 3*a* and 3*b*, the superimposing of the re-mapped object image onto the base image for display as blended image 303 at a display screen, such as display screen 222 of communication device 102.

Figure 4:
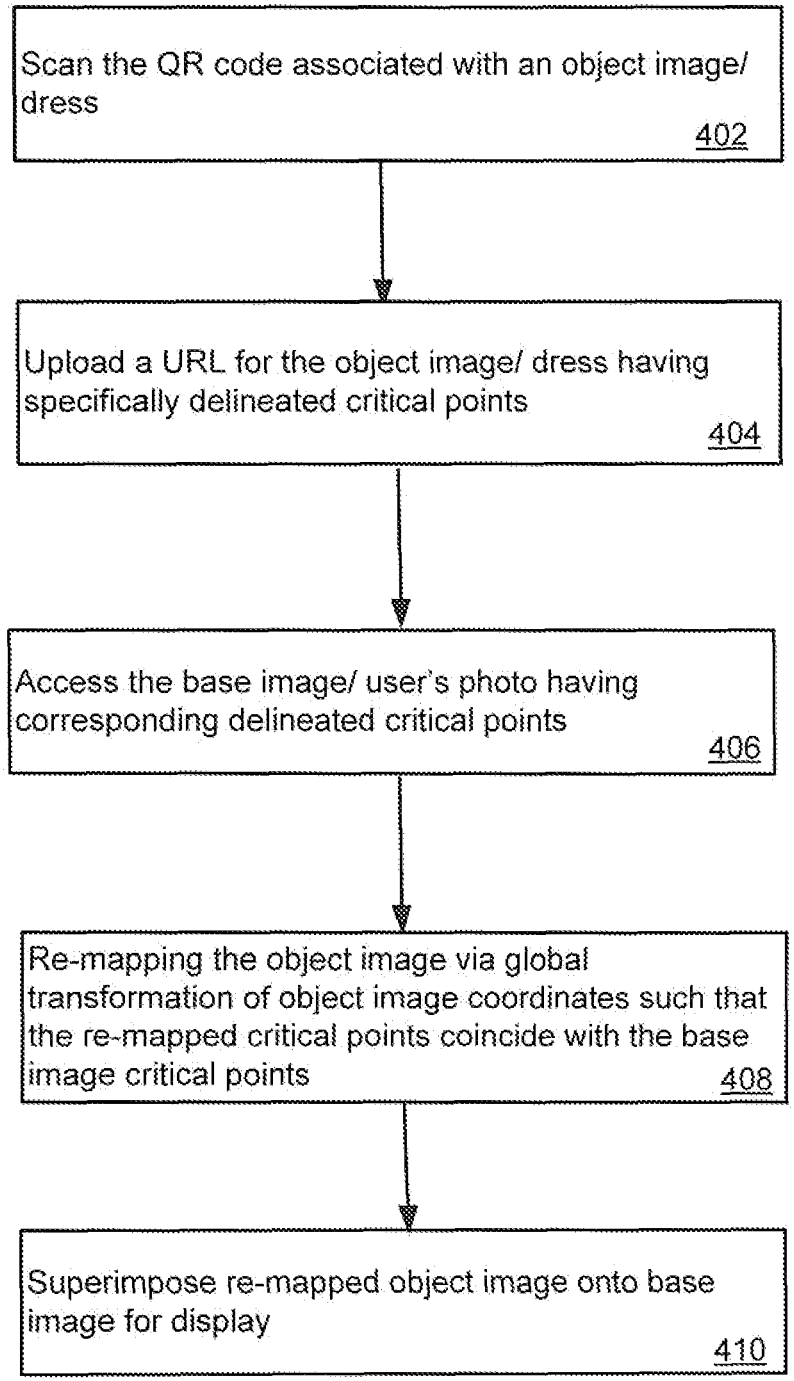
FIG. 4 illustrates an embodiment of a process for achieving the virtual dressing room based on superimposing the object image onto the base image, for viewing in the display screen.

FIG. 4 illustrates an embodiment of a process for achieving the virtual dressing room based on transforming the object image to reshape and re-size it to appropriately fit the base image, then superimposing the object image onto the base image, for viewing in the display screen of communication device 102.

At step 402, the QR code, barcode or other encoded indicium placed on an advertisement associated with an object such as a bridal dress is scanned.

At step 404, a URL for that specific object image/ bridal dress being advertised or displayed is uploaded, the object image having specifically delineated critical points as discussed above with regard to object image 302.

At step 406, the base image, such as a user's photograph including body profile data is accessed from base image database 192. As discussed above with regard to base image 301, the accessed data includes data for the specifically delineated critical points of base image 301.

At step 408, re-mapping of the object image 302 via global transformation of object image coordinates is performed, such that the re-mapped critical points coincide with the corresponding critical points of base image 301. The re-mapping process simulates stretching of the non-linearly stretchable object image 302, in this case the dress, resulting in a reshaped and re-sized dress that appropriately fits the base image 301, depicted as the model's body profile in the embodiment shown in FIGS. 3*a* and 3*c*, for example.

At step 410, re-mapped object image 302 is superimposed onto base image 301 to form a blended image 303 for display at display screen 222 of communication device 102. One aspect of forming the blended image includes assigning respective RGB values of the critical points of the object image 302 as transformed to the corresponding critical points of the base or body image 301.

FIGS. 5*a* and 5*b* depict in more detail, stretching of the object image via global transformation of the object image coordinates, including re-mapping its critical points to coincide with the corresponding base image critical points. The stretching process is depicted on the coordinate grids shown as before and after the stretching, respectively at FIGS. 5*a* and 5*b*. The stretching process comprises planar rearrangement of the non-linearly stretchable object image 302 to match 4 key points on the body image 301, initially. This initial step comprises selecting point P defined by 4 key points on the body image 301. Then mapping point P based on relative position to the 4 key points, comprising relative distance D. Next finding a point Q on the dress image with the same relative distance D to the 4 key points on the dress image 302, then assigning the RGB value at point Q on the dress image to the body image 301 at point P. The above steps are then repeated for all points on the body image 301.

The planar re-arrangement step is followed by successive sets of 4-20 stretching steps of the object image 302 in order to align all object image key points to the body or base image key points. Based on the difference in key points between the warped dress image and the body image, a series of stretching steps consisting of pushing points in a general direction, is performed as follows. For every point Q on the dress image, shift the points by a delta Q based on the difference between critical key point X on the dress image and critical key point X' from the body image outlined on the dress image as outlined above. This then repeated for all critical key points that are not a part of the initial 4 key points chosen. This process simulates stretching of the non-linearly stretchable object image 302, in this case the dress, to create a reshaped and re-sized dress that appropriately fits the base image 301.

It is contemplated that the planar image re-mapping and superimposition techniques described herein are relevant and applicable to other contexts besides a virtual dressing room. Although the invention has been described with reference to specific illustrative embodiments pertinent to a virtual dressing room context in the disclosure herein, other modifications and applications thereof will be apparent to those skilled in the art without departing from the scope of the invention as defined by the appended claims.

What is claimed is:

1. A method of superimposing an object image onto a base image in a display screen of a communication device, the images being planar, the method comprising:

scanning an encoded indicium associated with the object image;

accessing and uploading a universal resource locator (URL) associated with the object image, the object image including a plurality of object image critical points;

accessing the base image at the communication device, the base image including a plurality of base image critical points respectively corresponding to the object image critical points;

re-mapping the object image via global transformation consisting of:

(i) performing a regional two-dimensional linear re-mapping based on a first set of object image critical points, said pre-defined mask object region corresponding to the plurality of base image critical points; and (ii) performing a plurality of local vector-based non-linear image transformations based on a pair of coordinates defining a vector obtained from a second set of object image critical points and the plurality of base image critical points;

such that the re-mapped object image critical points coincide with the respective base image critical points; and superimposing the re-mapped object image onto the base image for display at the display screen.

2. The method of claim 1 wherein the communication device comprises a mobile communication device.

3. The method of claim 1 wherein the communication device comprises an internet-enabled kiosk.

4. The method of claim 1 wherein the communication device comprises a computer coupled with a webcam.

5. The method of claim 1 wherein the encoded indicium comprises a quick response (QR) code.

6. The method of claim 1 wherein the encoded indicium comprises a barcode.

7. The method of claim 1 wherein the object image comprises a digital image of an article of clothing.

8. The method of claim 1 wherein the base image comprises a digital photograph image of at least a portion of a human body profile.

9. The method of claim 1 wherein superimposing the re-mapped object image onto the base image comprises assigning respective red-green-blue (RGB) values of the critical points of the object image to corresponding critical points of the body profile image.

10. The method of claim 1 wherein the re-mapping the object image via global transformation of coordinates comprises:

re-arranging at least four key points of the object image to coincide with a respective at least four of key points of the object image; and stretching the object image in successive steps to align an additional set of object image key points to coincide with a respective additional set of base image key points.

11. A computer system comprising a non-transitory computer readable memory, the memory having instructions stored thereon which when executed, cause the computer to implement the steps of claim 1.

12. A communication device for creating and displaying an object image superimposed onto a base image in a display screen, the communication device comprising:

a code scanner module for scanning an encoded indicium associated with the object image;

a base image database having the base image, the base image including a plurality of base image critical points;

a coordinate transformation module for re-mapping the object image via global transformation of coordinates associated with a plurality of object image critical points, the object image critical points respectively corresponding to the base image critical points, the image transformation consisting of:

(i) performing a regional two-dimensional linear re-mapping based on a first set of object image critical points, said region comprised of a pre-defined mask object region, said pre-defined mask object region corresponding to the plurality of base image critical points; and (ii) performing a plurality of local vector-based non-linear image transformations based on a pair of coordinates defining a vector obtained from a second set of object image critical points and the plurality of base image critical points;

such that the re-mapped object image critical points coincide with the respective base image critical points, the object image being accessed and uploaded via a universal resource locator (URL) associated therewith; and a superimposition module for superimposing the re-mapped object image onto the base image for display at the display screen.

13. The method of claim 12 wherein the communication device comprises a mobile communication device.

14. The method of claim 12 wherein the communication device comprises a communication network-accessible computer coupled with a webcam.

15. The method of claim 12 wherein the encoded indicium comprises a quick response (QR) code.

16. The method of claim 12 wherein the encoded indicium comprises a barcode.

17. The method of claim 12 wherein the object image comprises a digital image of an article of clothing.

18. The method of claim 12 wherein the base image comprises a digital photograph image of at least a portion of a human body profile.

19. The method of claim 12 wherein the superimposition module superimposes the re-mapped object image onto the base image by assigning respective red-green-blue (RGB) values of the critical points of the object image to corresponding critical points of the body profile image.

* * * * *